United States Patent [19]

MacVane

[11] Patent Number: 5,013,321

[45] Date of Patent: May 7, 1991

[54] GEL-DISPENSING PACIFIER

[76] Inventor: Benjamin F. MacVane, P.O. Box 7422, Alexandria, La. 71301

[21] Appl. No.: 256,594

[22] Filed: Oct. 12, 1988

[51] Int. Cl.[5] ..... A61J 17/00

[52] U.S. Cl. ..... 606/234; 215/11.5

[58] Field of Search ..... 128/359, 360; 215/11.1–11.6, 100 A; 606/234–236

[56] References Cited

U.S. PATENT DOCUMENTS

| | | | |
|---|---|---|---|
| 1,518,823 | 12/1924 | Schmidt et al. | 128/360 |
| 2,889,829 | 6/1959 | Tannenbaum et al. | 215/11.1 |
| 3,292,808 | 12/1966 | Greene | 215/11.5 |
| 4,577,632 | 3/1986 | Grasset | 128/360 |

*Primary Examiner*—Stephen C. Pellegrino
*Assistant Examiner*—William Lewis

[57] ABSTRACT

A gel-dispensing pacifier which includes a nipple provided with one or more openings that communicate with a hollow interior, a guard attached to the nipple to prevent an infant from swallowing the nipple and a valve-equipped teething ring threadibly attached to the nipple, wherein a sweetened or fruit-flavored gelatin or "gel" is provided in the nipple for dispensing through an opening or openings in the nipple. In a preferred embodiment, the nipple element is fitted with external threads for mating with the internal threads on a gel tube for introducing gel into the nipple. In another preferred embodiment of the invention the teething ring element includes an air intake opening and a ball valve which communicates with the nipple interior, in order to facilitate introduction of air into the nipple to displace the gel sucked from the nipple and to seal the air intake opening from reverse flow of gel.

2 Claims, 1 Drawing Sheet

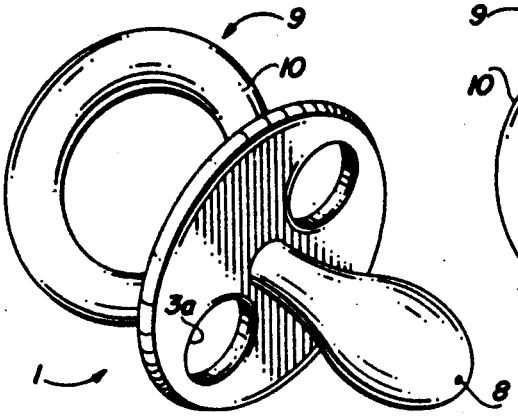
FIG. 1
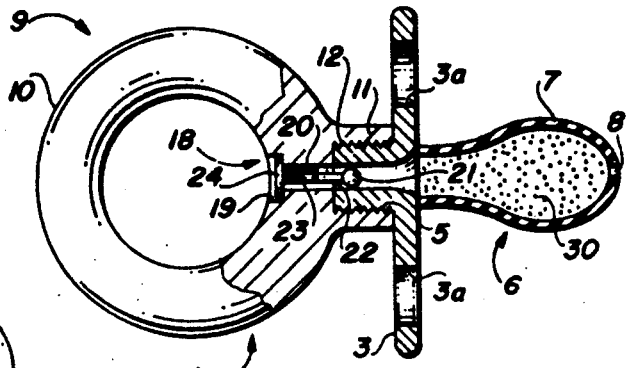
FIG. 2
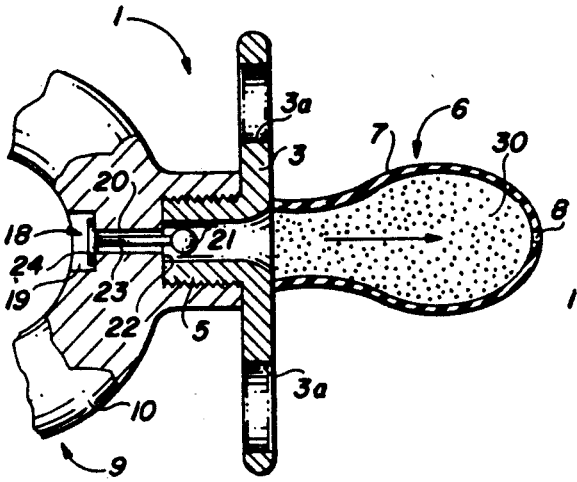
FIG. 3
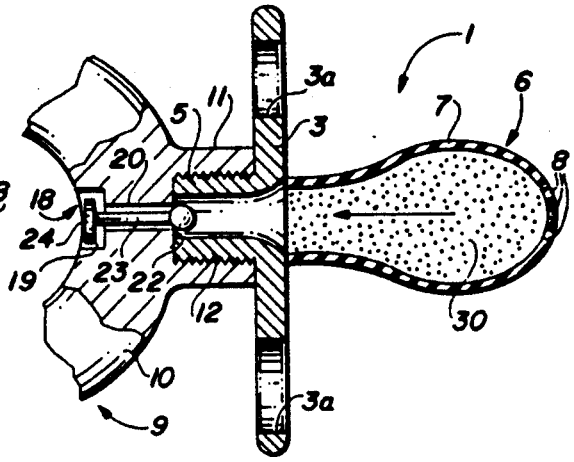
FIG. 4
FIG. 5
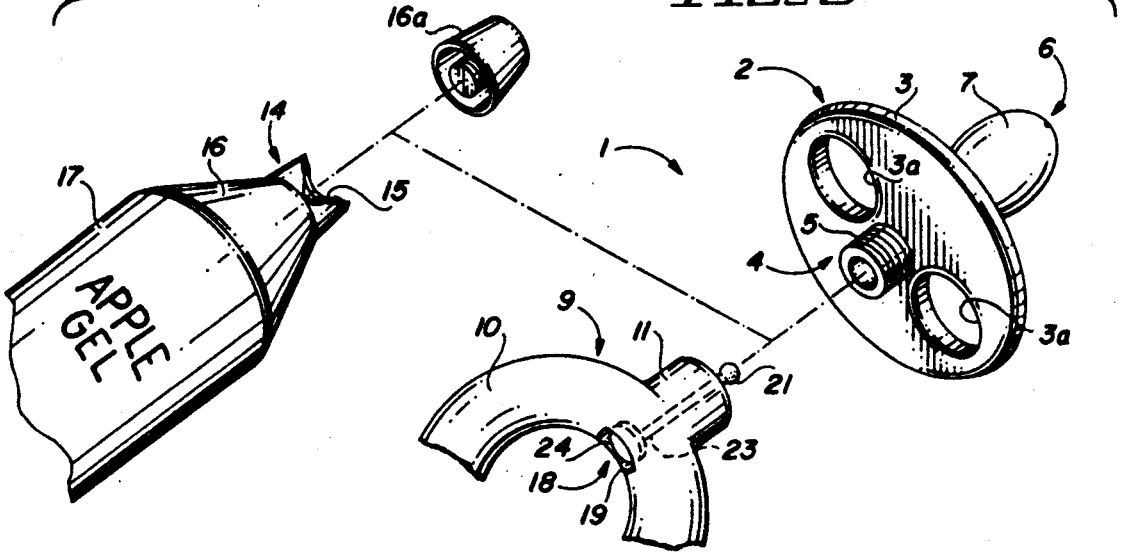

GEL-DISPENSING PACIFIER

BACKGROUND OF THE INVENTION

1. Field of the Invention

This invention relates to pacifiers for infants and more particularly, to a gel-dispensing pacifier which is characterized in a preferred embodiment by a gel-containing nipple provided with a conventional guard and a threaded ring mount extending from the guard for removably receiving a ring which is adapted to prevent the flavored gelatin material, or "gel" from exiting the nipple through the ring mount. In a most preferred embodiment, the ring element includes internal threads for threaded attachment to the mount threads on the ring mount and the nipple is capable of being loaded with gel from a gel-containing tube, by means of nozzle threads located on a projecting nozzle. In another most preferred embodiment of the invention, the gelatin material or "gel" is contained in the nipple by means of a ball valve which is slidably mounted in a seat opening located in the ring seat and ring.

2. Description of the Prior Art

Pacifiers have long been used to satisfy the sucking instinct of infants between meals. Such pacifiers typically consist of a flexible nipple provided with a guard to prevent the infant from ingesting the pacifier nipple and a ring for grasping and holding the pacifier and for teething. One of the problems associated with conventional pacifiers is that of satisfying the infant between meals, since no food or milk is dispensed through the pacifier responsive to the sucking action.

Various attempts have been made to alleviate the problem of pacifier rejection, including the placing of sweetened materials such as frozen fruit juice and candy pellets inside the pacifier nipple to satisfy the infant. Typical of these devices is the "Pacifier With Sweets-Dispensing Nipple", disclosed in U.S. Pat. No. 4,192,307, dated Mar. 11, 1980, to Allen R. Baer. This patent details a pacifier for infants which is characterized by a hollow nipple having a multi-perforated wall. In use, the nipple chamber is supplied with flavored sweets such as pellets of candy or frozen fruit juices. When the nipple is placed in the infant's mouth, saliva circulates through multiple perforations in the nipple and the resulting sweetened fluid flowing through the openings in the nipple encourages the infant to retain the nipple in its mouth. U.S. Pat. No. 3,669,117, dated June 13, 1972, to Murray Herbst, discloses a "Combination Teether and Pacifier". The device detailed in this patent includes a thin-walled, flexible body having nipple guard and teething portions which are hollow and located in communication with each other. A soft, compressible body of gel or liquid is provided in the hollow portions of the pacifier, in order to encourage the infant to maintain the pacifier in its mouth. A "Medicated Pacifier" is disclosed in U.S. Pat. No. 2,612,165, dated Sept. 30, 1952, to Joseph J. Szuderski. The medicated pacifier detailed in this patent includes a multi-perforated nipple, a guard mounted on the nipple and a nozzle fitted with a threaded cap removably provided inside the nipple for introducing medication into the nipple and dispensing the medication to the infant by sucking action when the infant retains the pacifier nipple in its mouth. Other patents which are of interest in this regard are as follows: U.S. Pat. No. 2,889,829, dated June 9, 1959, to Tannenbaum, et al. U.S. Pat. No. 4,570,808, dated Feb. 18, 1986, to Campbell, et al; U.S. Pat. No. 4,640,282, dated Feb. 3, 1987, to Careborg; U.S. Pat. No. 58,186, dated Sept. 18, 1866, to Bourguard; U.S. Pat. No. 1,637,919, dated Aug. 2, 1927, to Whitlock; U.S. Pat. No. 4,558,792, dated Dec. 17, 1985, to Cabernoch, et al; U.S. Pat. No. 3,145,867, dated Aug. 25, 1964, to Roberts, et al; U.S. Pat. No. 2,836,321, dated May 27, 1958, to Soltesz, et al; U.S. Pat. No. 1,607,055, dated Nov. 16, 1926, to Cooper; U.S. Pat. No. 3,669,117, dated June 13, 1972, to Herbst; and U.S. Pat. No. 3,610,248, dated Oct. 5, 1971, to Davidson.

It is an object of this invention to provide a new and improved gel-dispensing pacifier which is characterized by a nipple having at least one opening therein, a guard attached to the nipple and a ring portion adapted for threadible attachment to the guard and provided with a partially hollow interior for receiving a valve to facilitate introduction of air into the ring portion and the nipple and dispensing of the gel material from the pacifier nipple to an infant.

Another object of this invention is to provide a new and improved gel-dispensing pacifier which is characterized by a removable ring portion provided with a valve, in order to maintain the gel flowable in the pacifier nipple for dispensation to an infant.

Another object of the invention is to provide a gel-dispensing pacifier which includes a nipple provided with at least one gel-dispensing opening communicating with the interior thereof, a guard attached to the nipple, a threaded ring mount projecting from the guard for receiving a companion internally-threaded ring element which is provided with an interior chamber extending partially through the ring element for receiving a valve, wherein the ring mount can be threaded on the nozzle of a gel-containing tube and the nipple refilled with gel, as desired.

SUMMARY OF THE INVENTION

These and other objects of the invention are provided in a new and improved gel-dispensing pacifier which includes a nipple provided with one or more openings communicating with the hollow interior thereof for dispensing gel to an infant, a guard attached to the nipple and a ring element attached to the guard, with a valve slidably located in the ring element to introduce air into the nipple and facilitate dispensing the gel from the nipple responsive to sucking of the nipple by an infant. The valve also prevents gel from being forced from the nipple rearwardly through the ring element and valve when the infant bites the nipple.

BRIEF DESCRIPTION OF THE DRAWING

The invention will be better understood by reference to the accompanying drawing, wherein:

FIG. 1 is a perspective view of a preferred embodiment of the gel-dispensing pacifier of this invention;

FIG. 2 is a side view, partially in section, of the gel-dispensing pacifier illustrated in FIG. 1, more particularly illustrating a valve slidably mounted in the ring element of the gel-dispensing pacifier;

FIG. 3 is a side view, partially in section, of the gel-dispensing pacifier illustrated in FIG. 1, with the valve positioned in the gel-dispensing configuration;

FIG. 4 is a side view, partially in section, of the gel-dispensing pacifier illustrated in FIG. 1, with the valve positioned in the gel-contained configuration; and FIG. 5 is an exploded view of the gel-dispensing pacifier of this invention, more particularly illustrating a gel-containing tube for filling the nipple.

DESCRIPTION OF THE PREFERRED EMBODIMENTS

Referring to FIGS. 1-5 of the drawing, in a first preferred embodiment of the invention the gel-dispensing pacifier is characterized by a teething ring pacifier 1. The teething ring pacifier 1 is further characterized by a pacifier element 2, which includes a hollow nipple 6 provided with a nipple opening 8 in the end thereof and secured to a round guard 3 at the opposite end. A quantity of gel 30 can be introduced into the hollow interior of the nipple 6 through the ring mount 4 as hereinafter described and the gel is contained by the relatively thick nipple wall 7 of the nipple 6, as illustrated. The ring mount 4 projects from the opposite side of the guard 3 from the nipple 6 and is provided with multiple mount threads 5. The ring mount 4 is also provided with an internal bore (not illustrated) which communicates with the hollow interior of the nipple 6, for introducing the gel 30 into the nipple 6, as hereinafter further described. A ring element 9 is designed for threaded attachment to the pacifier element 2 of the teething ring pacifier 1 by means of internal seat threads 12, provided in a cylindrically-shaped ring seat 11, as illustrated in FIG. 2. The ring seat 11 extends from a ring 10 which is provided with a valve 18, which includes a valve seat 19 and a seat opening 20, extending from the valve seat 19 and communicating with the internal opening located in the ring mount 4 and with the gel 30, located in the nipple 6, as further illustrated in FIG. 2. A valve neck 23 is slidably disposed in the seat opening 20 and a ball 21 is attached to one end of the valve neck 23 and selectively seats in the ball seat 22. A ball stay 24 is attached to the opposite end of the valve neck 23 and locates in the valve seat 19. The ring 10 may be constructed of relatively hard plastic or soft plastic material, in order to act as a "teether", of desired resiliency.

As illustrated in FIG. 5, quantities of the gel 30 can be introduced into the nipple 6 by threading the mount threads 5 in the ring mount 4 into the nozzle threads 15 of the tube nozzle 14 extending from the gel tube 13 and pressing the gel tube 13. In a most preferred embodiment of the invention, the gel tube 13 is characterized by a conventional flexible tube such as a toothpaste tube, having a body 17 filled with gel 30 and a tube neck 16 which tapers from the tube body 17 to the tube nozzle 14. When the nipple 6 is substantially filled with gel 30, the ring mount 4 is unthreaded from the internal nozzle threads 15 in the tube nozzle 14 and the ring mount 4 is reinserted on the ring 10 by engaging the seat threads 12 with the mount threads 5, as illustrated in FIG. 2. Pressure applied by sucking action of an infant on the nipple 6 causes gel to flow from the nipple 6 through the nipple opening 8, to the infant. This flow is expedited by a flow of air around the non-sealing ball stay 24, through the seat opening 20 and into the nipple 6 in the direction of the arrow in FIG. 3. Accordingly, it will be appreciated from a consideration of FIG. 5 that gel 30 can be introduced into the interior of the hollow nipple 6 by operation of the gel tube 13, to satisfy an infant for an extended period of time. When this initial charge of gel 30 is exhausted, additional gel 30 can be injected into the nipple 6 as often as desired.

Referring now to FIG. 4 of the drawing, it will be appreciated that the nipple 6 of the teething ring pacifier 1 illustrated in FIG. 1 can be provided with multiple nipple openings 8 instead of a single nipple opening 8, depending upon the viscosity of the gel 30 located inside the nipple 6 and the size of the feeding infant. Furthermore, it will also be appreciated that the size of the nipple openings 8 can be varied, depending upon the number of nipple openings 8 provided in the nipple 6. Moreover, when the infant bites the nipple 6 and forces the gel 30 rearwardly toward the guard 3 in the direction of the arrow, this pressure shifts the valve 18 and causes the ball 21 to seat in the ball seat 22, to prevent gel from flowing through the seat opening 20.

It will be further appreciated by those skilled in the art that various types of fruit gel are available from various manufacturers in gel tubes 13 having threaded tube nozzles 14. These gels include such fruit flavors such as apple, pear, banana and the like and are of a suitable viscosity to be easily introduced into the nipple 6 in the teething ring pacifier 1. The gels are most preferably characterized by a viscosity which decreases with increasing body temperature and therefore flows easily from the nipple 6 by the sucking action of the infant. The gels used in the gel-dispensing pacifier of this invention are not intended for consumption per se, but rather, to increase and enhance pacification of an infant. By way of comparison, the various gels satisfy the infant much in the same manner that an after dinner mint satisfies an adult. It is understood that other edible, flavored, heat-sensitive substances, including coated substances known to those skilled in the art can be used in the gel-dispensing pacifier of this invention.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A gel-dispensing pacifier comprising a nipple having a hollow interior for containing a supply of gel; at least one gel-dispensing opening provided in said nipple, said gel-dispensing opening communicating with said hollow interior; a guard carried by said nipple opposite said gel-dispensing opening; a guard opening provided in said guard, said guard opening communicating with said gel-dispensing opening; a ring removably carried by said guard for handling said pacifier; a valve seat provided in said ring, a seat opening projecting through said ring, said seat opening communicating with said valve seat, said guard opening and said hollow interior of said nipple; a valve neck slidably disposed in said seat opening; a ball attached to one end of said valve neck facing said hollow nipple, said ball located in said guard opening; and a ball stay located in said valve seat and attached to the opposite end of said valve neck for transmitting air to said nipple and facilitating the dispensing of gel from said nipple to an infant.

2. A gel-dispensing pacifier comprising a nipple having a hollow interior for containing a supply of gel; a plurality of gel-dispensing openings provided in said nipple, said gel-dispensing openings communicating with said hollow interior; a round guard carried by said nipple opposite said gel-dispensing openings; a guard opening provided in said guard, said guard opening communicating with said gel-dispensing opening; a ring element fixedly carried by said guard; a set of mount threads provided on said guard and a set of ring threads provided on said ring element, whereby said mount threads threadably engage said ring threads and secure said ring element to said guard; and a valve seat provided in said ring, a seat opening projecting through said ring, said seat opening communicating with said valve seat, said guard opening and said hollow interior of said nipple; a valve neck slidably disposed in said seat opening; a ball attached to one end of said valve neck facing said hollow nipple, said ball located in said guard opening; and a ball stay located in said valve seat and attached to the opposite end of said valve neck for receiving air and transferring the air to said hollow interior in said nipple.

* * * * *